United States Patent [19]

Ney et al.

[11] Patent Number: 4,653,838

[45] Date of Patent: Mar. 31, 1987

[54] FILTERED ELECTRICAL CONNECTOR

[75] Inventors: Reuben E. Ney, Mount Joy; Bryon L. Walters, Camp Hill, both of Pa.

[73] Assignee: AMP Incorporated, Harrisburg, Pa.

[21] Appl. No.: 801,257

[22] Filed: Nov. 25, 1985

[51] Int. Cl.[4] ..... H01R 13/66

[52] U.S. Cl. ..... 339/147 R; 333/185

[58] Field of Search ..... 333/181–185; 339/143 R, 147 R, 147 C, 147 P

[56] References Cited

U.S. PATENT DOCUMENTS

| | | | |
|---|---|---|---|
| 4,126,840 | 11/1978 | Selvin | 333/79 |
| 4,371,226 | 2/1983 | Brancaleone | 333/183 |
| 4,376,922 | 3/1983 | Muzslay | 333/182 |
| 4,396,245 | 8/1983 | Lane | 339/38 |
| 4,589,720 | 5/1986 | Aujla et al. | 339/147 R |

*Primary Examiner*—Gil Weidenfeld
*Assistant Examiner*—Gary F. Paumen
*Attorney, Agent, or Firm*—Katherine A. Nelson

[57] ABSTRACT

A filtered, multiple terminal, electrical connector for use with circuit boards or the like. The connector comprises a housing, a plurality of terminals positioned in the housing, and a monolithic planar capacitor filter for filtering interference. The terminals comprise resilient spring members and are configured such that when a second connector is mated with the connector, the terminals of the second connector will apply a retention force against the terminals, forcing them toward and pressing them against the monolithic planar capacitor to maintain the terminals in firm electrical contact with the monolithic planar capacitor. The connector also includes U-shaped grounding clips having first arms which extend into the housing in electrical contact with the monolithic planar capacitor, and second arms external of the housing for providing external grounding paths. The terminals each include a protrusion thereon adapted to impinge shoulders on the housing to resist withdrawal of the terminals from the housing while permitting them to be easily inserted into the housing. The filtered connector is fully interchangeable with its unfiltered counterpart and is low in cost, simple in construction, and easy to assemble.

24 Claims, 5 Drawing Figures

FILTERED ELECTRICAL CONNECTOR

BACKGROUND OF THE INVENTION

The present invention relates generally to electrical connectors, and, more particularly, to filtered, multiple terminal electrical connectors for use with printed circuit boards or the like.

Commonly assigned U.S. Pat. No. 4,396,245 discloses a multiple terminal electrical connector designed for mounting on a circuit board. The connector comprises an elongated housing having a plurality of terminals loosely positioned therein. More particularly, the housing includes a central housing portion which extends substantially the length of the housing and defines two rows of spaced grooves on oppposite sides of a central dividing wall. Each terminal comprises a resilient spring member and includes a first end portion extending into one of the grooves; a second, central portion of curved or bowed configuration; and a third, opposite end portion extending outwardly of the housing to be mounted to a circuit board.

Because the terminals are only loosely positioned within the housing, they are susceptible to moving out of position within the housing or of slipping out of the housing entirely, particularly before the connector is mounted to the printed circuit board. To retain the terminals within the housing, therefore, the second curved portions are positioned to have a retention force applied thereagainst, causing the first end portions of the terminals to be forced toward and to press firmly against the central dividing wall.

As disclosed in U.S. Pat. No. 4,396,245, the retention force can be applied by a housing cover having depending ribs which contact and press against the curved portions of the terminals or by the terminals of a mating connector which similarly press against the curved portions of the terminals when the two connectors are mated.

The connector disclosed in U.S. Pat. No. 4,396,245 is highly desirable for use with circuit boards because it is small, simple in construction, low in cost, and capable of being preassembled prior to installation on a printed circuit board.

There are many applications in which it would be desirable to provide a connector of the type disclosed in U.S. Pat. No. 4,396,245 with a filtering capability; for example, to filter EMI or RFI interference or other undesired signals in circuits connected by the connector. In providing such a connector with a filtering capability, however, it is desirable that the cost and complexity of the connector not be significantly increased. In addition, it is desirable that the filtered connector be fully interchangeable with its unfiltered counterpart. This means that both filtered and unfiltered versions should be usable with the same mating connector and that both have substantially the same external configuration and dimensions and the same terminal placement so that either can be mounted at the same location on a printed circuit board.

SUMMARY OF THE INVENTION

In accordance with the present invention, an electrical connector is provided which comprises a housing, at least one terminal positioned within the housing, and a filter positioned within the housing for filtering interference, the at least one terminal comprising a resilient spring member having a first portion positioned adjacent the filter, and a second portion positioned to have a retention force applied thereagainst for causing the first portion to be forced toward and to press against the filter for maintaining electrical contact between the at least one terminal and the filter.

According to a presently preferred embodiment, the filter comprises an elongated monolithic planar capacitor, and the at least one terminal comprises a plurality of terminals having first portions positioned adjacent the monolithic planar capacitor and second, curved portions positioned to be contacted and deformed by the terminals of a mating connector to cause the first terminal portions to be forced forward and to push firmly against the capacitor to retain the terminals in electrical contact with the capacitor.

According to a presently preferred embodiment, a filtered electrical connector for printed circuit boards has, in effect, been provided by removing at least a portion of the central dividing wall in the unfiltered connector disclosed in U.S. Pat. No. 4,396,245 and replacing it with a monolithic planar capacitor. By modifying the unfiltered connector in this manner, connection with a mating connector not only helps to retain the terminals within the connector housing as in the unfiltered connector, but simultaneously ensures that the terminals will be retained in firm electrical contact with the filter whenever the connector is used, without any permanent, physical attachment of the terminals to the filter being necessary.

According to a further aspect of the invention, the connector includes grounding means electrically coupled to the filter for dissipating the filtered energy. In accordance with a presently preferred embodiment, the grounding means comprises a pair of U-shaped grounding clips having one arm portion extending into the housing and in electrical contact with the monolithic planar capacitor, and a second arm portion external of the housing for connection to external ground. Preferably, the U-shaped grounding clips include apertures in their arm portions aligned with apertures in the housing to receive conductive bolts to simultaneously attach the clips to the housing, mount the connector to a printed circuit board, and provide grounding paths from the grounding clips through the bolts to the printed circuit board.

According to yet a further aspect of the invention, the connector includes latching means to help retain the terminals within the housing and increase the resistance of the terminals against being pulled out of the housing. According to a presently preferred embodiment, the latching means comprises a dimple provided on each terminal and adopted to be engaged by a shoulder on the housing to oppose withdrawal of the terminals from the housing. This latching feature is particularly important in helping to retain the terminals in the housing during assembly of the connector. Other latching features such as a lance may also be used.

By the present invention, a connector of the type disclosed in U.S. Pat. No. 4,396,245 has been provided with a filtering capability while retaining the same external dimensions and configuration and the same terminal placement as the unfiltered connector. The filtered connector of the present invention is fully interchangeable with the unfiltered version thereof and is low in cost, simple in construction and easy to assemble.

Further advantages of the invention will become apparent hereinafter in the following detailed description of a presently preferred embodiment taken in conjunction with the drawings.

DETAILED DESCRIPTION OF A PRESENTLY PREFERRED EMBODIMENT

Figure 1:
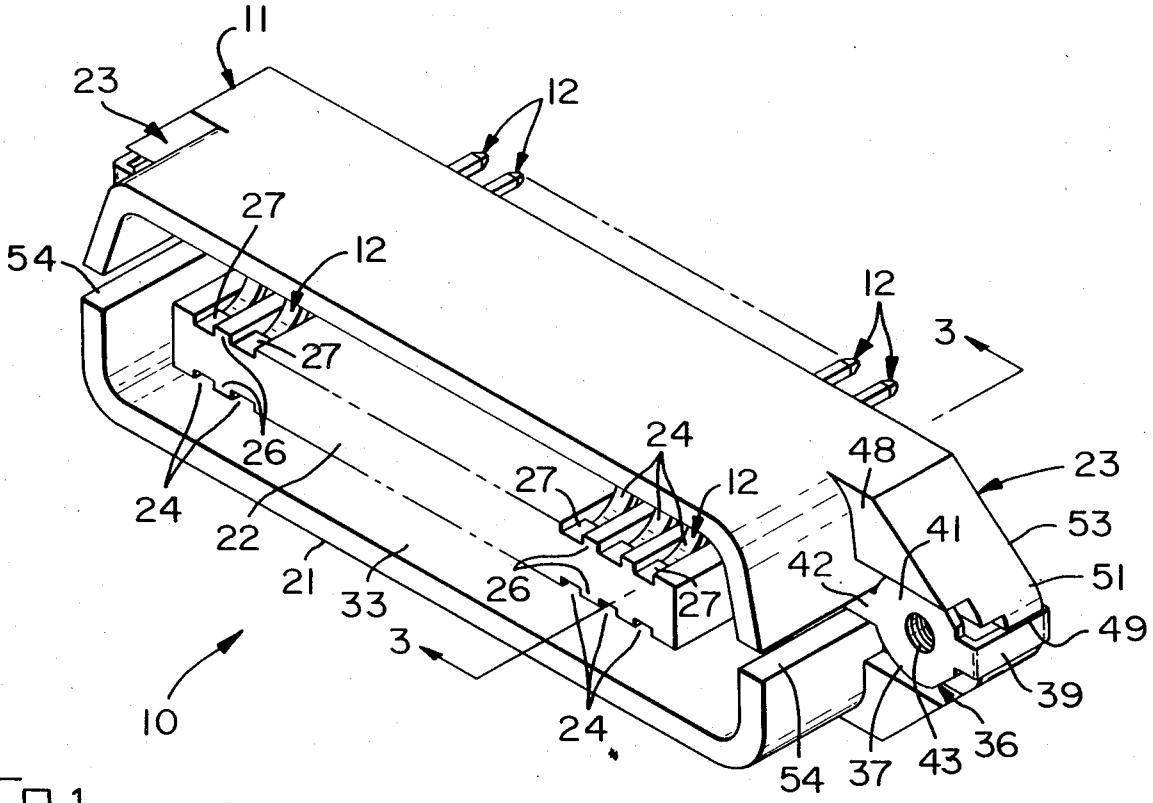
FIG. 1 is a perspective view of an electrical connector according to a presently preferred embodiment of the invention.
Figure 2:
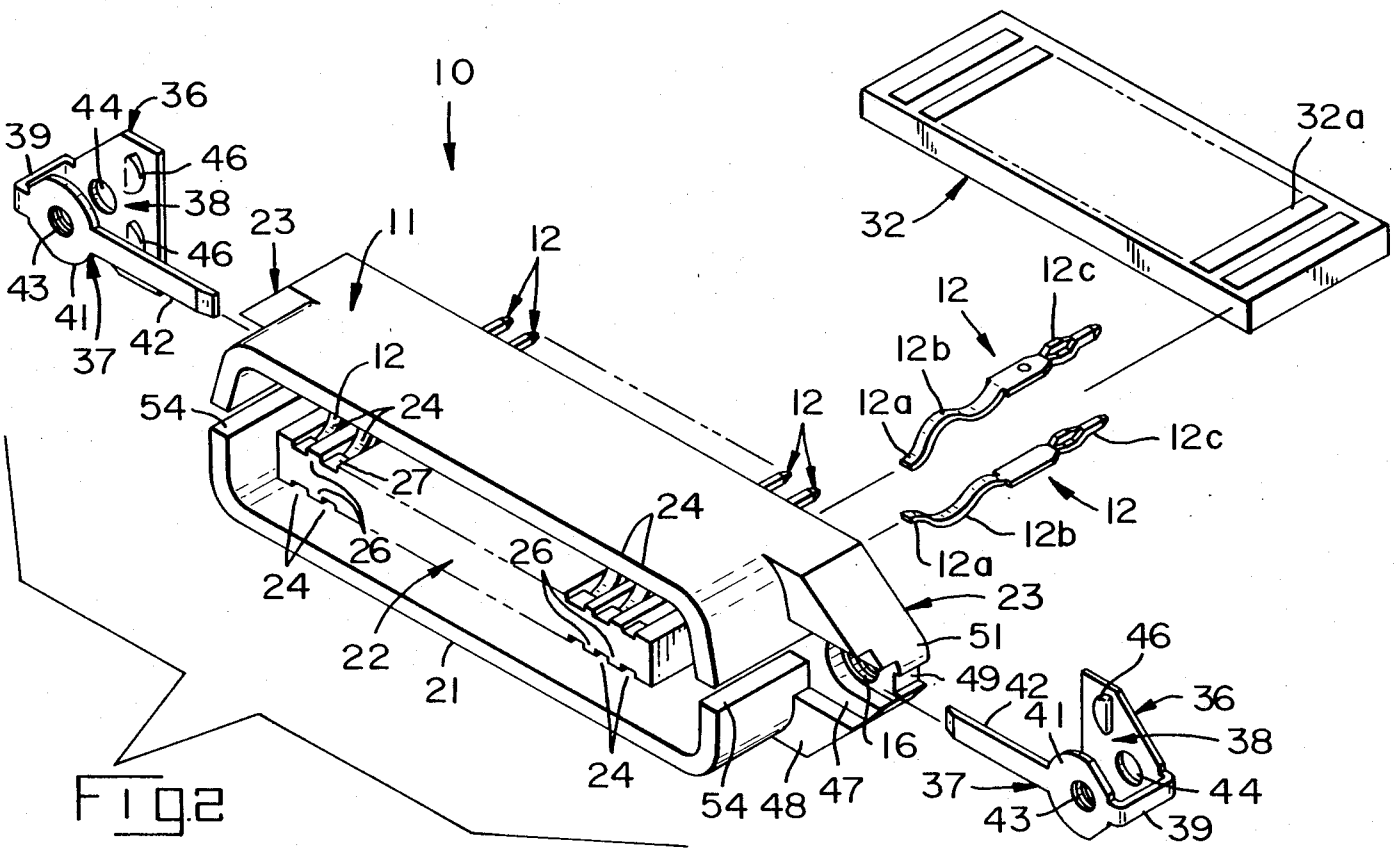
FIG. 2 is an exploded perspective view of the connector of FIG. 1.

FIGS. 1 and 2 illustrate assembled and exploded views, respectively, of a filtered electrical connector according to a presently preferred embodiment of the invention. The connector is generally designated by reference numeral 10, and comprises a housing 11 containing a plurality of terminals 12.

Figure 5:
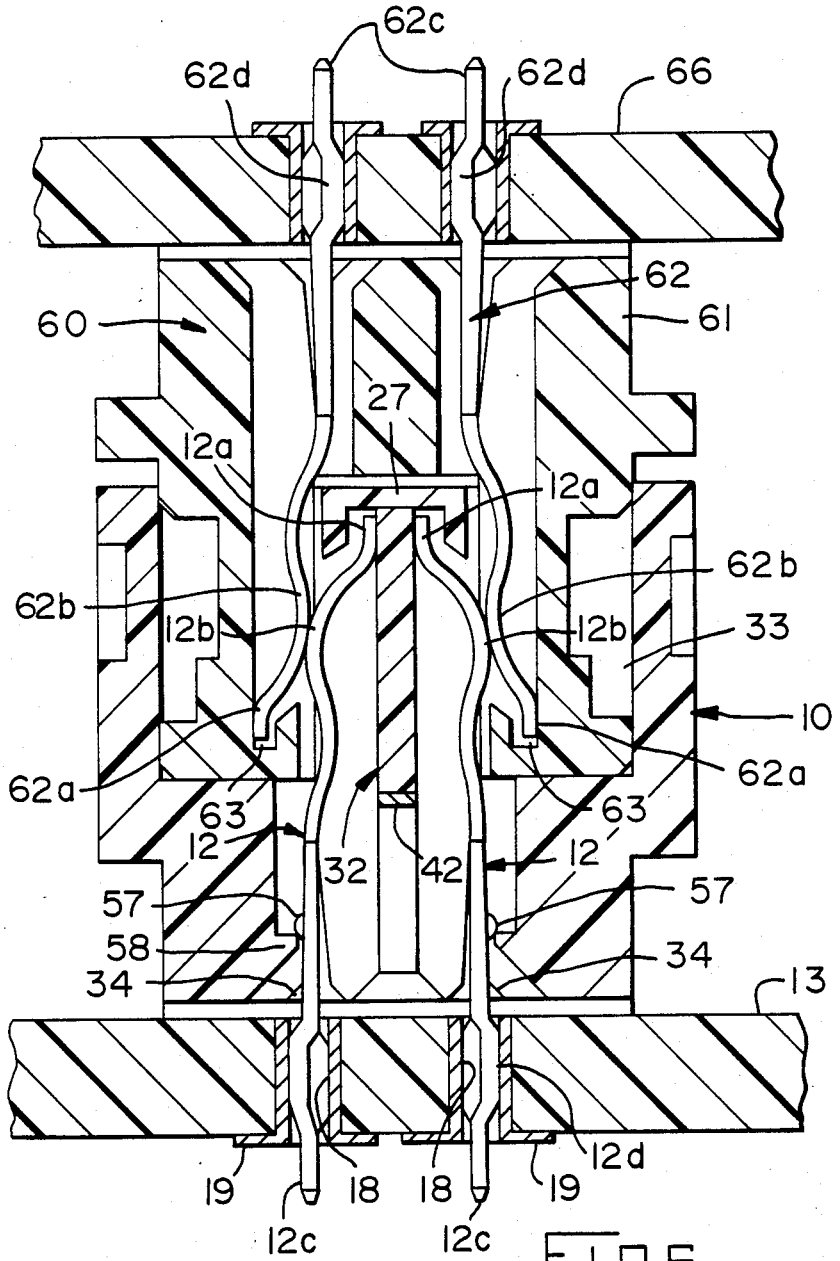
FIG. 5 is a cross-sectional view of a connector assembly comprising the connector of FIG. 1 connected to a mating connector.

Connector 10 is particularly designed for use with circuit boards or the like, and can be mounted to a circuit board 13 by extending a pair of bolts 14 or other fasteners through aligned apertures 16 and 17 in the housing 11 and the board 13, respectively, as shown in FIG. 14. When the connector 10 is mounted to a circuit board 13, terminals 12 extend through holes 18 in the board and are electrically coupled to conductive paths 19 thereon as shown in FIG. 5.

Housing 11 comprises an elongated member of generally rectangular cross section, and is preferably formed of a dielectric material such as glass-reinforced polyester or another suitable plastic material.

Housing 11 is preferably of one-piece construction and includes an outer wall portion 21 substantially surrounding the connector 10 and an integral central portion 22. In addition, housing 11 includes a pair of flange portions 23 which extend outwardly from each end of housing 11 and contain the apertures 16 through which mounting bolts 14 extend to mount the connector to a printed circuit board 13.

Figure 3:
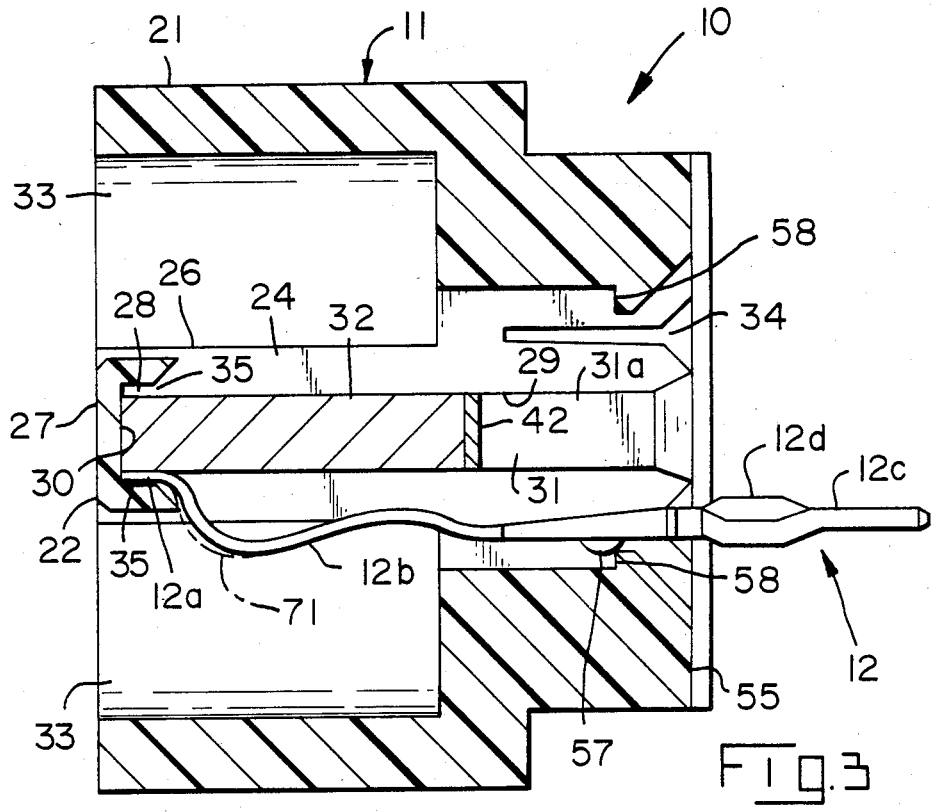
FIG. 3 is a cross-sectional view of the connector of FIG. 1 taken along the line 3—3 in FIG. 1, with portions removed for clarity.

Central housing portion 22 is configured to define a plurality of spaced terminal-receiving channels 24 separated from one another by a plurality of intermediate wall portions 26. As shown in FIG. 3, the terminal-receiving channels 24 are substantially open and each includes a downwardly facing, U-shaped, upper wall 27 defining a cavity 28 therein. As is also shown in FIG. 3, the intermediate wall portions 26 each have a narrow, vertical slot 29 extending therethrough which are in alignment with one another. The aligned vertical slots 29 define a continuous elongated passageway or slot 31 which extends the entire length of central portion 22 through each individual wall slot 29 and is in communication with each terminal-receiving channel 24 therebetween. As will be explained more fully hereinafter, slot 31 is adapted to receive a monolithic planar capacitor 32 to provide connector 10 with a filtering capability.

A plurality of terminals 12 is positioned within housing 11 of connector 10. As shown in FIGS. 2, 3 and 5, each terminal comprises an elongated, non-linear member which includes a first, relatively straight end portion 12*a* which extends into cavity 28 of U-shaped wall 27, a second intermediate portion 12*b* of curved or bowed configuration, and a third, relatively straight end portion 12*c* which extends out of housing 11 through openings 34 in the base of the housing and includes a compliant section 121 to be mounted to the circuit board 13. Terminals 12 are formed of an electrically conductive, resilient, spring material as known in the art.

A pair of terminals 12 is positioned in opposite sides of each terminal-receiving channel 24 of central housing portion 22 to provide two parallel rows of terminals extending substantially the length of central housing portion 22. Each terminal 12 is identical in construction; however, as shown in FIG. 5, the terminals of each row are oriented such that their second, curved portions 12*b* will be bowed outwardly into space 33 between the outer wall 21 and central portion 22 of housing 11.

A monolithic planar capacitor 32 is positioned within elongated slot 31, and is sized to extend substantially the entire length of slot 31. As best shown in FIG. 3, capacitor 32 is positioned within slot 31 to abut the lower surface 30 of each U-shaped wall portion 27, and is somewhat narrower than the cavities 28 in U-shaped wall portions 27 to define a pair of grooves 35 within each cavity 28 on opposite sides of capacitor 32. Capacitor 32 is also sized to occupy only the upper portion of slot 31, leaving an unfilled lower portion 31*a*.

Monolithic planar capacitor 32 functions as an electrical filter to filter EMI and RFI interference and other unwanted noise in circuits connected by connector 10. Such devices are well-known and commonly used in electrical circuits for filtering purposes, and need not be described in detail herein. Monolithic planar capacitor are commercially available in accordance with the particular filtering characteristics desired; and a suitable monolithic planar capacitor for use in connector 10 and has a capacity of from about 100 to about 1500 pfd. Examples of monolithic planar capacities are also disclosed in U.S. Pat. Nos. 4,126,840 and 4,376,922.

Figure 4:
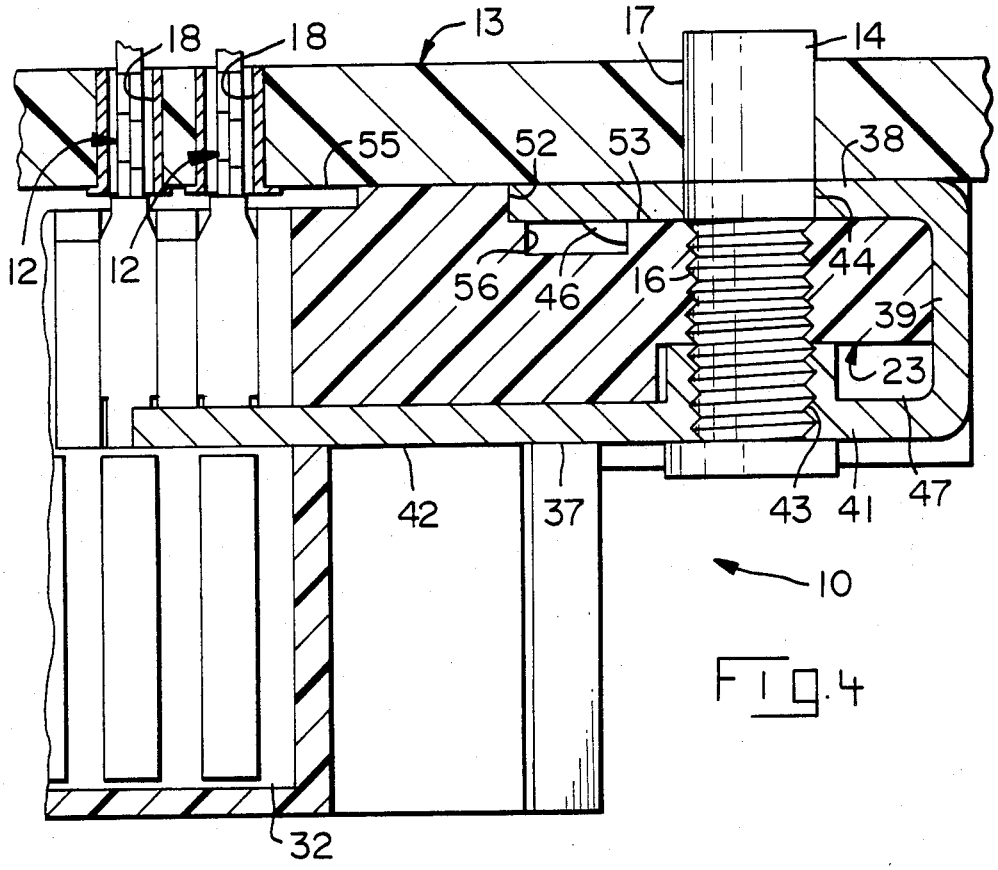
FIG. 4 is an enlarged cross-sectional view of a portion of the connector of FIG. 1 to illustrate a feature thereof.

Connector 10 also includes a pair of grounding clips 36 as best shown in FIGS. 2 and 4, to dissipate the energy filtered by monolithic planar capacitor filter 32. Grounding clips 36 are identical in construction and comprise one-piece, generally U-shaped members having upper and lower arm portions 37 and 38 connected together by a neck portion 39. Upper arm portion 37 comprises a generally rounded portion 41 having a narrow finger portion 42 extending outwardly therefrom. As shown in FIG. 4, a portion of rounded portion 41 is of increased thickness and has a threaded aperture 43 extending therethrough.

Lower arm portions 38 of grounding clips 36 are substantially parallel to upper arm portions 37 and include apertures 44 extending therethrough in alignment with apertures 43. Lower arm portions 38 also each include a pair of retaining lugs 46 as shown in FIGS. 2 and 4.

Grounding clips 36 are adapted to be mounted to flange portions 23 of housing 11 as illustrated in FIGS. 1 and 2. To receive the grounding clips 36, each flange 23 is formed with a groove 47 on its upper surface 48, a groove 49 on its side surface 51, and a cut-away portion 52 on its base surface 53 (see FIG. 4). Outer wall portion 21 of housing 11 is also provided with a pair of slots 54 to receive narrow finger portions 42 of grounding clips 36 when the clips are positioned on flanges 23.

FIG. 4 illustrates a grounding clip 36 assembled to a flange 23 of housing 11. When mounted to flange 23, rounded portion 41 will be positioned in groove 47; neck portion 39 will be positioned in groove 49; and lower arm portion 38 will extend into cut-away portion 52. When properly positioned, apertures 43 and 44 in the arm portions of the grounding clip will be aligned with aperture 16 in flange 23 such that mounting bolt 14 can be extended through all three aligned apertures to simultaneously attach the grounding clip to the housing and mount the connector as a whole to the circuit board 13. Also, lugs 46 will snap into notches 56 in the flanges 23 to help retain the clips 36 in position on the flanges until the mounting bolts 14 are inserted.

When grounding clips 36 are mounted to flanges 23 of housing 11, finger portions 42 will extend through slots 54 in sidewall portion 21 of housing 11 and a short distance into each end of the lower portion 31*a* of elongated slot 31. More particularly, as shown in FIGS. 3 and 5, finger portions 42 will extend beneath the ends of monolithic planar capacitor 32, and, in doing so, provide a support for the monolithic planar capacitor 32 and help retain it in position within the upper portion of slot 31. At the same time, finger portions 42 are in electrical contact with the grounding pads of the capacitor to provide a grounding path from the capacitor to the grounding clips 36.

Grounding clips 36 can be constructed from a variety of appropriate electrically conductive materials. With the present invention, grounding clips 36 simultaneously support the monolithic planar capacitor 32 in position with the connector 10 and provide large, U-shaped grounding surfaces for effectively dissipating energy filtered by the capacitor. In addition, mounting bolts 14 are preferably also formed of an electrically conductive material, such that when the connector is mounted to a circuit board, a continuous grounding path is automatically provided from the grounding clips 36 through the bolts 14 to the ground plane on circuit board.

Terminals 12 are adapted to be inserted into housing 11 through openings 34 in the base 53 of housing 11. As best shown in FIG. 3, terminal portion 12*a* of terminals 12 will extend into grooves 35 defined in cavity 28 on either side of monolithic planar capacitor 32; curved portions 12*b* will extend into space 33; and end portions 12*c* including compliant sections 12*d* will extend out of housing 11 through openings 34. Terminals 12 are each formed to have a small protrusion such as dimple 57, a cantilevered beam (not shown) or the like thereon. Because of the springiness of the terminals 12, they can easily be inserted into the connector through openings 34; however, once inserted, withdrawal of the terminals from the housing will be resisted by dimples 57 engaging shoulders 58 on housing 11. The dimples 57, in conjunction with shoulders 58, thus function as latching means, permitting easy insertion of the terminals while increasing the resistance of the terminals against being pulled out of the housing. This is an important feature because the terminals are not physically attached to the housing, but are only positioned therein; and until the connector is mounted to a printed circuit board care must be taken to prevent them from being accidentally pulled out of the housing.

Connector 10 comprises a male connector and is designed to mate with a female connector to complete electrical circuits through the connector. An assembly comprising connector 10 mated to a female connector 60 is illustrated in FIG. 5. Female connector 60 includes a housing 61 having a plurality of terminals 62 positioned therein. Terminals 62 are similar to terminals 12 except that they are rotated 180° about their axes such that their curved portions 62*b* will be bowed inwardly. Also, housing 61 is formed to define a set of grooves 63 in the outer wall of the housing 61 rather than in a central housing portion as in housing 11.

Terminals 62 are inserted into housing 61 such that inner end portions 62*a* thereof extend into grooves 63, and outer opposite end portions 62*c* extend out of the housing 61 and include compliant sections 62*d*. Third end portions 62*c* can be mounted to a circuit board 66, as shown in FIG. 5, to a multiline cable, or otherwise coupled to electrical circuits to be connected through the connector assembly.

To mate connectors 10 and 60, female connector housing 61 is plugged into space 33 defined between the outer wall portion 21 and central portion 22 of housing 11. When so connected, the inwardly bowed terminal portions 62*b* of female connector terminals 62 will contact and press against the outwardly bowed portions 12*b* of terminals 12. This will establish electrical contact between the terminals of the two connectors to connect electrical circuits through the connectors. At the same time, female terminal portions 62*b* will apply retention forces against outwardly bowed terminal portions 12*b* which will deform terminal portions 12*b* inwardly by a small amount. This is illustrated in FIG. 3 wherein broken line 71 identifies the normal, undeformed position of terminal portion 12*b*. When connectors 10 and 60 are mated, however, as shown in FIG. 5, terminal portions 62*b* will press against and deform terminal portions 12*b* into the position shown in solid line in FIG. 3. This will cause first end portions 12*a* of terminals 12 to move toward and press firmly against respective conductive areas 32 or a monolithic planar capacitor 32 to establish and maintain the terminals in electrical contact with capacitor 32.

With the present invention, the terminals 62 of mating connector 60 ensure that the terminals will be reliably maintained in firm, electrical contact with the monolithic planar capacitor 32 whenever the connectors are mated, and, hence, whenever the connector assembly is in use. This is achieved without requiring soldering or any other permanent attachment of the terminals to the capacitor that would increase the cost and complexity of the connector and decrease its flexibility.

With the present invention also, the grounding clips 36 provide support for the monolithic planar capacitor within the housing 11, and, at the same time, provide a large grounding surface external of the housing for effectively and reliably dissipating filtered energy. The grounding clips are also designed such that they are attached to the housing 11 automatically when the housing is mounted to a circuit board while simultaneously providing a continuation of the grounding path from the clips through the mounting bolts to the printed circuit board.

The filtered connector 10 has substantially the same external configuration and size and the same terminal placement as the unfiltered connector disclosed in U.S. Pat. No. 4,396,245, and is fully interchangeable therewith. The same housing cover disclosed in U.S. Pat. No. 4,396,245 to retain the terminals within the housing during handling and storage of the connector disclosed therein may be used in filtered connector 10; and either the filtered or unfiltered connector may be mated with the same mating connector. Because of the manner in which the terminals are maintained in contact with the monolithic planar capacitor, the tolerances on the capacitor are relatively loose, permitting a reduction in manufacturing costs.

While what has been described constitutes a presently preferred embodiment, it should be understood that numerous changes may be made without departing from the invention. For example, if desired, the female connector 60 can be provided with a filtering capability rather than the male connector. Because many modifications are possible, it should be understood that the invention is to be limited only insofar as is required by the scope of the following claims.

We claim:

1. An electrical connector comprising:

housing means;

at least one terminal positioned within said housing means; and a filter means positioned within said housing means for filtering interference, said at least one terminal comprising a resilient spring member having a first portion positioned adjacent to but not necessarily in contact with said filter means and not being a unitary part of said filter means, and a second portion positioned to have a retention force applied thereagainst by means of a mating contact for causing said first portion to be forced toward and to press against said filter means for maintaining electrical contact between said at least one terminal and said filter means.

2. The connector as described in claim 1 wherein said first portion of said at least one terminal comprises an end portion thereof, and wherein said second portion comprises a curved portion, said second curved portion being deformed by said retention force to cause said first end portion to be forced toward and pressed against said filter means.

3. The connector as described in claim 1 wherein said at least one terminal is positioned within said housing and said retention force maintains electrical contact between said at least one terminal and said filter means.

4. The connector as described in claim 3 and further including grounding means electrically coupled to said filter means for dissipating filtered energy, said grounding means including a first portion extending into said housing means in electrical contact with said filter means, and a second portion external of said housing means for providing an external grounding path for dissipating said filtered energy.

5. The connector as described in claim 4 wherein said housing means includes an aperture for receiving a fastener to mount said housing means to a mounting surface, and wherein said first and second portions of said grounding means include apertures in alignment with said aperture in said housing means whereby said fastener simultaneously attaches said grounding clip to said housing means and mounts said housing means to said mounting surface.

6. The connector as described in claim 5 wherein said fastener is formed of electrically conductive material to provide a grounding path from said grounding means through said fastener to said mounting surface.

7. The connector as described in claim 3 and further including latching means for permitting insertion of said at least one terminal into said housing means while resisting withdrawal of said at least one terminal from said housing means.

8. The connector as described in claim 3 wherein said filter means comprise a monolithic planar capacitor, and wherein said at least one terminal comprises a plurality of terminals, each of said plurality of terminals having a first portion forced toward and pressed against said monolithic planar capacitor when said retention force is applied against a second curved portion thereof.

9. The connector as described in claim 8 wherein said plurality of terminals comprises two rows of terminals and wherein said monolithic planar capacitor is positioned between said two rows of terminals.

10. The connector as described in claim 9 and further including at least one grounding means for dissipating filtered energy, said grounding means having a first portion extending into said housing for supporting said monolithic planar capacitor and in electrical contact therewith, and a second portion external of said housing means for providing an external grounding path for dissipating said filtered energy.

11. The connector as described in claim 10 wherein said first and second portions of said grounding means each include apertures aligned with an aperture in said housing means, said aligned apertures being adapted to receive a fastener for simultaneously attaching said at least one grounding means to said housing means and for mounting said housing means to a mounting surface.

12. An electrical connector assembly comprising:

a first connector, said first connector including a housing means, a plurality of terminals positioned within said housing means, and a filter means positioned within said housing means for filtering interference, said terminals not being unitary with said filter means, and said terminals not necessarily being in contact with said filter means; and a second connector adapted to mate with said first connector to complete electrical circuits through said connector assembly, said second connector including means for applying a retention force when said first and second connectors are mated for maintaining said plurality of terminals and said filter in electrical contact with one another.

13. The connector assembly as described in claim 12 wherein said means for applying a retention force comprises means for applying said retention force against each of said plurality of terminals causing said plurality of terminals to be forced toward and to press against said filter means.

14. The connector assembly as described in claim 13 wherein said means for applying a retention force comprises a plurality of terminals in said second connector, said plurality of terminals in said second connector contacting said plurality of terminals in said first connector when said first and second connectors are mated for simultaneously completing electrical circuits through said first and second connectors, and applying a retention force against said plurality of terminals in said first connector for pressing said plurality of terminals in said first connector against said filter means.

15. The connector assembly as described in claim 14 wherein each of said plurality of terminals in said first connector comprises a resilient spring member positioned within said housing means and having a first end portion positioned adjacent said filter means, a second curved portion, and a third opposite end portion extending outwardly of said housing, and wherein said plurality of terminals in said second connector applies said retention force against said second terminal portions, deforming said second terminal portions and causing said first end portions to be forced toward and pressed against said filter means for maintaining electrical contact between said terminals in said first connector and said filter means.

16. The connector assembly as described in claim 15 wherein said plurality of terminals in said first connector comprises two rows of terminals, and wherein said filter means comprises a monolithic planar capacitor positioned between said two rows of terminals.

17. The connector assembly as described in claim 16 and further including a U-shaped grounding clip on said first connector for dissipating filtered interference, said grounding clip including a first arm extending into said housing means in electrical contact with said monolithic planar capacitor, and a second arm external of said housing means for providing an external grounding path for dissipating said filtered energy.

18. The connector assembly as described in claim 17 wherein said first and second arms include apertures aligned with an aperture in said housing means, and wherein said assembly further includes a conductive fastener extending through said aligned apertures for simultaneously attaching said grounding clip to said housing and mounting said housing to a circuit board while providing a grounding path from said grounding clip through said fastener to said circuit board.

19. An electrical connector for matable electrical connection with a complementary electrical connector, comprising:

housing means;

at least one electrical terminal means positioned within said housing means, said at least one electrical terminal having a resilient spring portion;

monolithic filter means positioned within said housing means, said filter means having conductor means disposed thereon, said terminal means not being unitary with said filter means and not necessarily being in contact with said filter means;

retention means for retaining the resilient spring portion of said at least one terminal means in electrical engagement with said conductor means of said filter means by a retention force generated by a complementary connector matable therewith;

securing means for securing said at least one terminal means in said housing means; and grounding means for providing an external ground path for said filter means.

20. An electrical connector as described in claim 19 wherein said grounding means comprises a U-shaped grounding clip having a first portion extending into said housing means and in electrical contact with said filter means, and a second portion external of said housing means.

21. An electrical connector comprising:

housing means;

a plurality of terminals positioned within said housing means, each of said terminals comprising a resilient spring member;

a monolithic planar capacitor positioned within said housing means for filtering interference, said plurality of terminals not being unitary with said capacitor, each of said terminals having a first end portion positioned adjacent to but not necessarily in contact with said monolithic planar capacitor, a second curved central portion and a third opposite end portion extending outwardly of said housing means to be mounted to a circuit board, said second curved portions being positioned to have a retention force applied thereagainst for deforming said second curved portions to cause said first end portions to be forced toward and pressed against said monolithic planar capacitor for maintaining said plurality of terminals in electrical contact with said monolithic planar capacitor; and at least one grounding clip having a first portion extending into said housing means in electrical contact with said monolithic planar capacitor and a second portion external of said housing means for providing an external grounding path for dissipating filtered energy.

22. The connector as described in claim 21 wherein said first and second portions of said at least one grounding clip includes an aperture aligned with an aperture in said housing means, said aligned apertures being adapted to receive a fastener for simultaneously attaching said at least one grounding clip to said housing means and for mounting said housing means to said circuit board.

23. An electrical connector assembly comprising:

a first connector, said first connector including:

housing means;

a plurality of terminals positioned within said housing means, each of said plurality of terminals comprising a resilient spring member;

a monolithic planar capacitor positioned within said housing means for filtering interference, said plurality of terminals not being unitary with said capacitor, each of said terminals having a first end portion positioned adjacent to but not necessarily in contact with said monolithic planar capacitor, a second curved central portion, and a third opposite end portion extending outwardly of said housing means to be mounted to a circuit board; and at least one U-shaped grounding clip having a first arm extending into said housing means in electrical contact with said monolithic planar capacitor and a second arm external of said housing means for providing an external grounding path for dissipating filtered energy; and a second connector adapted to mate with said first connector, said second connector including a plurality of terminals for contacting the terminals in said first connector when said connectors are mated for simultaneously completing electrical circuits through said first and second connectors and for applying a retention force against the second curved portions of said terminals in said first connector for deforming said second portions and causing said first portions to be forced toward and to press against said monolithic planar capacitor for maintaining electrical contact with said monolithic planar capacitor.

24. The connector assembly as described in claim 23 wherein said first connector includes a pair of U-shaped grounding clips, and wherein the first and second arms of each of said grounding clips include apertures aligned with an aperture in said housing means, and wherein said assembly further includes a pair of fasteners extending through said aligned apertures for simultaneously attaching said grounding clips to said housing means and for mounting said first connector to said circuit board.

* * * * *